US005674433A

United States Patent [19]

Semmens et al.

[11] Patent Number: 5,674,433

[45] Date of Patent: Oct. 7, 1997

[54] HIGH EFFICIENCY MICROBUBBLE AERATION

[75] Inventors: Michael J. Semmens; Charles J. Gantzer; Michael J. Bonnette, all of Minneapolis, Minn.

[73] Assignee: Regents of the University of Minnesota, Minneapolis, Minn.

[21] Appl. No.: 519,125

[22] Filed: Aug. 24, 1995

[51] Int. Cl.[6] ..... B01F 3/04

[52] U.S. Cl. ..... 261/37; 261/122.1; 261/87; 261/93; 261/120; 261/DIG. 75

[58] Field of Search ..... 261/122.1, 37, 261/87, 93, 120, DIG. 75

[56] References Cited

U.S. PATENT DOCUMENTS

| | | | |
|---|---|---|---|
| 3,228,876 | 1/1966 | Mahon | 210/22 |
| 3,702,658 | 11/1972 | McNamara et al. | 210/321 |
| 4,181,604 | 1/1980 | Onishi et al. | 210/8 |
| 4,781,889 | 11/1988 | Fukasawa et al. | 422/48 |
| 4,824,444 | 4/1989 | Nomura | 55/16 |
| 4,886,601 | 12/1989 | Iwatsuka et al. | 210/321.79 |
| 4,950,431 | 8/1990 | Rudick et al. | 261/122.1 |
| 5,034,164 | 7/1991 | Semmens | 261/122 |
| 5,059,374 | 10/1991 | Krueger et al. | 204/156 |
| 5,143,612 | 9/1992 | Hamanaka et al. | 210/321.8 |
| 5,228,991 | 7/1993 | Strohm et al. | 210/321.8 |
| 5,254,253 | 10/1993 | Behmann | 210/607 |
| 5,332,498 | 7/1994 | Rogut | 210/321.8 |

FOREIGN PATENT DOCUMENTS 0 138 060 A3 4/1985 European Pat. Off. .

OTHER PUBLICATIONS

"Untersuchung der Blasenbildung und des Stoffaustausches unter dem Einfluß oberflächenaktiver Substanzen und gelöster Gase" (English translation of Chapter 5.1 and Figures 89, 90 and 91 as shown in the German text pp. 134, 136, 137 and 138) by Franz Bischof, Feb. 10, 1994.

"High Oxygen Transfer Rate in a New Aeration System Using Hollow Fiber Membrane", by Hiroshi Matsuoka et al. *Biotechnology and Bioengineering*, vol. 40, pp. 346–352 (1992).

*Primary Examiner*—Tim R. Miles

*Attorney, Agent, or Firm*—Westman, Champlin & Kelly, P.A.

[57] ABSTRACT

An aeration device disperses microbubbles into a liquid and maintains efficient transfer of gas to the liquid. The aeration device uses a number of sealed end, hollow fiber membranes that are hydrophobic and provided with pores in the walls of the tubular fibers that range from about 0.01 to 1.0 microns, so that very small bubbles are formed on the outside surface of the hollow fiber membranes. Gas pressures above the bubble point of the fiber membranes are used, and a cloud of microbubbles is expelled into the liquid as it is forced to flow past the fibers. These microbubbles provide a large surface area for the effective dissolution of gases into the liquid. The length of the hollow fiber membranes is controlled in order to obtain efficient small bubble formation.

13 Claims, 6 Drawing Sheets

HIGH EFFICIENCY MICROBUBBLE AERATION

This invention was made with Government support under NSF/BCS-9123175 awarded by the National Science Foundation. The Government has certain rights in this invention.

BACKGROUND OF THE INVENTION

The present invention relates to a gas transfer device that provides highly efficient transfer of a gas such as oxygen into liquids, such as wastewater, using tubular wall fiber membranes having micropores through the wall. Open ends of the fiber membranes are provided with a gas such as air or oxygen under pressure sufficient to cause gas to bubble through the micropores. The micropores are sized so that the bubbles are very small and are released in clouds as the liquid passes over the exterior of the tubular fiber membranes.

Conventional wastewater treatment tank aeration devices attempt to efficiently transfer gas through the water while providing the required level of mixing to keep the microorganisms uniformly dispersed throughout the treatment tank. Normally, when gases bubble into the water, the rising bubbles generate the required mixing. Studies have shown that conventional fine bubble diffusers have an optimum bubble size of around 2 mm to satisfy gas transfer and mixing functions. Typically, conventional diffusers of this type dissolve only about 20–50% of the oxygen in the air supplied as the input gas, which means that the majority of the oxygen is lost back to the atmosphere when the bubbles burst at the water surface. This makes the use of conventional fine bubble diffusers inappropriate for use with pure oxygen since a high wastage rate would render the process prohibitively expensive.

A commercially available oxygenator is sold under the trademark "Vitox System" . In this system, a high pressure pump delivers a high flow rate of water to a Venturi which is equipped with small holes in the throat or reduced section of the Venturi. Pure oxygen is blown through the holes and as the water passes the holes at high velocity, the water shears fine bubbles from the surface of the wall. A jet of fine bubbles is then discharged into a deep tank and the energy of the jet provides mixing. The efficiency is depth dependent, but with discharges in deep tanks, the oxygen transfer rate efficiency is said by the manufacturer to approach 95%.

A membrane bioreactor that uses a combination of microbubbles and macrobubbles is shown in U.S. Pat. No. 5,254,253.

The use of hollow fiber membranes for gas transfer has been recognized as potentially reducing the cost of gas transfer by reducing energy requirements and increasing the efficiency of the gas transfer. When using hollow fiber membranes, the mixing and gas transfer functions are separate and may be engineered separately to meet the needs of a particular application. The hollow fiber membranes are preferably made specifically to produce very fine bubbles. Mixing must be (for this type of aerator) provided by a separate high flow, low head pump, or mixer.

SUMMARY OF THE INVENTION

The present invention relates to the use of tubular or hollow fiber membranes that have at least one open inlet end for receiving a gas such as oxygen or air. (Both ends of the fiber membranes can be connected to an air or oxygen source, or a remote or distal end can be closed or sealed.) The walls of the membrane forming the hollow fibers are provided with micropores such that when a gas under pressure is supplied to the interior of the hollow fibers, microbubbles will form on the exterior surface of the fiber membranes and will be stripped off by liquid moving past the fiber membrane exterior surface. The bubble size is maintained small in order to provide for good gas transfer to the liquid. The bubbles are purposefully discharged and dispersed in a large volumetric flow rate so they remain separate, and the opportunity for coalescence to form larger bubbles is minimized.

Inlet gas pressure is regulated so that microbubbles are formed on the fiber membrane surface at the micropores through the fiber membrane. The fiber membranes are arranged in the aerator to ensure that they are adequately dispersed in the fluid flow to ensure stripping the bubbles from the fiber membrane surface. The water velocity past the external surface of the hollow fiber membrane disperses the generated bubbles into a large water flow which also aids in controlling the size of the bubbles.

Microbubbles are defined as bubbles which measure less than 100–200 μm in diameter and as a result they have a very large surface area in relation to the volume of gas forming the bubbles and this enhances the effective mass transfer of gas to the liquid. Bubbles that are less than 100 μm in size are less inclined to coalesce, and this is likely due to charge acquisition at the bubble interface. As the bubble size is reduced, the surface area to volume ratio for the bubble increases and the effect of the charged surface becomes more important in determining the behavior of the bubble. Bubbles carrying like electrostatic charges tend to repel one another and this reduces coalescence. These electrostatic interactions dominate the behavior of very small bubbles (10 μm).

The fiber membranes are mounted in manifolds in various configurations that aid in dispersing the bubbles into large water flows and thus aid in transfer of gas into the water or liquid flowing past the fiber membranes. Many different configurations of hollow fiber membrane mounting manifolds can be used.

The microbubble forming hollow fiber membranes provide a highly efficient transfer of gases, such as oxygen into liquids. Small diameter, hollow fibers made of membranes that have small pores through the walls are suitable.

DETAILED DESCRIPTION OF THE PREFERRED EMBODIMENTS

Figure 1:
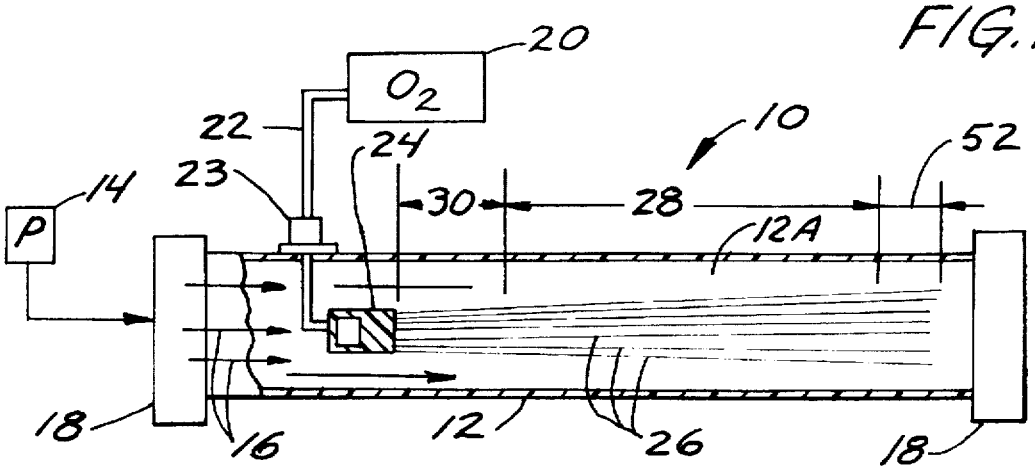
FIG. 1 is a schematic side elevational view of a typical installation utilizing hollow fiber membranes made according to the present invention.

In FIG. 1, a schematic representation of a high efficiency microbubble aeration device is illustrated generally at 10. The aeration device 10 includes a pipe section 12 through which water will flow from a pump 14 or other flow source as indicated by the arrow 16. The pipe section 12 can have unions at its opposite ends indicated at 18 for connecting into any type of desired flow pipe.

The liquid flow rate through the pipe section 12 is adjustable by adjusting flow source or pump 14, and the cross sectional size of the pipe section 12 can be changed as desired to provide the flow conditions for best gas transfer.

As shown schematically, a source of oxygen under pressure 20 is connected through a conduit 22 and a fitting 23 to a manifold illustrated schematically at 24. The manifold 24 can be of any desired type that will transfer gases into the interior of hollow fiber membranes. For example, reference is made to U.S. Pat. No. 5,034,164, and to co-pending U.S. application Ser. No. 08/303,021 filed Sep. 8, 1994, now abandoned both owned by the assignee of this application, for showings of suitable manifolds.

The manifold 24 provides gas under pressure to the interior of each of a plurality of tubular or hollow fiber membranes 26 which have first ends open to the interior of the manifold 24 and which have sealed or closed remote ends. The hollow fiber membranes 26 are in the interior passage way 12A of the pipe section 12, and the flow of water past the hollow fiber membranes 26 will tend to fluidize the outer or remote ends of the fiber membranes so that the hollow fiber membranes 26 remain spaced apart. A central length portion of each hollow fiber membrane 26, generally represented by the position of double arrow 28 is where transfer of gas from the interior of the hollow fiber membranes to the exterior will take place. The gas-to-liquid transfer is through very small pores which cause microbubbles to form at the exterior surface of the hollow fiber membranes.

The inner end section of the hollow fiber membranes indicated by the double arrow 30 usually will be treated chemically to close the pores in the hollow fiber membranes to prevent bubble formation adjacent to the manifold. High gas pressure present at the manifold 24 could result in excess formation of bubbles on the end sections 30 of the hollow fiber membranes. Because the hollow fiber membranes 26 are close together adjacent to the manifold, if bubbles formed along section 30 they would tend to coalesce quickly to form larger bubbles. In the central regions or sections 28, the hollow fiber membranes 26 become separated, so that microbubble formation is enhanced and the bubbles tend to remain separated. Water may be discharged through the pores under pressure. Water condensing in the interior of the fibers usually will transfer to end section 52 of the fiber membranes and be forced out of the pores adjacent this end.

The length of the hollow fiber membrane sections 30 can vary but the length is usually at least 5 cm and ranges up to 10 cm from the surface of the supporting manifold.

Figure 2:
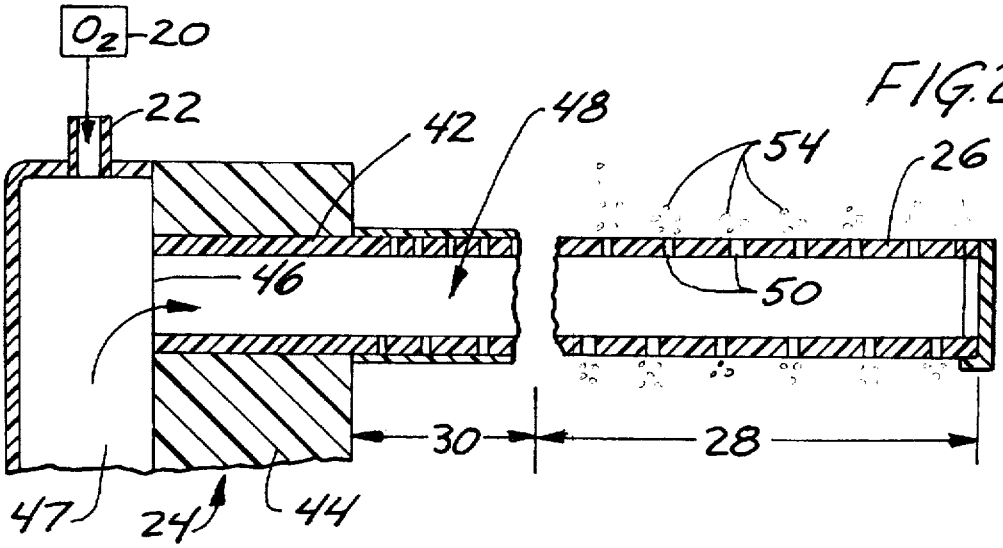
FIG. 2 is an enlarged schematic sectional view of a typical hollow fiber membrane used for the purposes of the present invention.

Referring to FIG. 2, a typical hollow fiber membrane 26 is illustrated. As shown, the hollow fiber membrane 26 has a first open end 42 potted or supported in a suitable potting material 44. An end opening 46 opens to the manifold 24, so that oxygen or air in the manifold plenum chamber 47 is provided to the lumen 48 of each hollow fiber membrane 26. The hollow fiber membranes 26 have walls made of suitable hydrophobic material that have micropores indicated schematically at 50 therein. The micropores are very small, and in the range of 0.01 to 10 microns and since the membrane material is hydrophobic the pores remain dry and gas filled when it is contacted with water. The end sections 30 of the hollow fiber membranes adjacent the manifold 24 are chemically treated to close the pores in sections 30 so that the oxygen does not pass through the membrane wall in these end sections.

The midsection 28 of the hollow fiber membranes 26 (also called fibers for convenience) is where the microbubbles are formed by gas transferring through the pores of the membranes.

The hollow fiber membranes 26 will spread out or separate, as shown in FIG. 1, by the action of water flowing over the outside of the fiber membranes. The hollow fiber membranes tend to "fluidize" and become distributed throughout the cross section of pipe section 12.

The micropores permit trapped liquid to transfer out of the interior of the fiber membranes when sufficient pressure is present on the interior of the fiber membrane.

The pressure within the lumena 48 of the hollow fiber membranes is adjusted to suit the length of the fiber membranes for increasing efficiency. Generally speaking, a gas pressure of at least 45 psi, above the water pressure will be utilized, and higher pressures also can be used. The pressure can be selected to suit the fiber membrane being used, the size of the fiber membrane, the pore size and the like.

Pressurized gas such as oxygen is pumped into the lumena 48 of very thin hollow fiber membranes 26, which have an outer diameter approximately in the range of 100 to 1,000 microns. The micropores, as stated, are very small, so that small bubbles are formed at the exterior surfaces of the hollow fiber membranes.

By pressurizing the lumena of the hollow fiber membranes with oxygen at a pressure above the bubble point of the membrane, oxygen will flow through the micropores 50 and form bubbles 54 on the outside surfaces of the fiber membranes 26. The size of the bubbles is determined not only by the dimension of the micropores, but also by the character of the external fiber membrane surface, which determines how quickly the bubbles shear off, the pressure of the oxygen inside the fiber membrane, the quality of the water being oxygenated and the water (liquid) velocity past the external surface of the hollow fiber membranes.

When pressurized gas is pumped into the lumena 48 of the very thin hollow fiber membranes to form microbubbles, there is a significant pressure drop along the lumena 48 of each fiber membrane extending from the manifold 24. As a result, the micropores near the mounting or proximal end of the fiber membranes release bubbles under the influence of a high pressure inside the fiber membranes while further down the fiber membranes, (at distal ends) the bubbles are formed at significantly lower internal pressure because of the pressure drop. It has been found that under fiber lengths longer than a length in the range of 30 cm to 50 cm cause the pressure inside the fiber membrane to drop to a level too low to form microbubbles through the micropores and the distal end of the fiber is not used effectively for gas transfer.

The length of the fiber membranes 26 affects the lateral fiber membrane movement in a flow stream. Longer fibers provide little lateral movement of sections of the fibers near the manifold, where bubble formation is enhanced since the fibers tend to remain in one position due to the drag on the downstream fiber length. By comparison, short fibers are much more free to move independently in a turbulent flow field, and as a result of the increased movement of the fibers and the enhanced liquid shear action at the fiber surfaces, bubble dispersion is likely to be more uniform.

The effectiveness or efficiency of a hollow fiber membrane microbubble aerator diminishes with increasing lengths of the fiber membranes. The length of the fibers is selected to provide a high efficiency.

Another factor in efficient gas transfer is the density of fiber membranes, that is, the spacing of the fiber membranes at the manifold 24 and in the pipe passageway 12A. As the fiber density increases, the opportunity for fiber to fiber contact increases, bubble interactions increase and bubble coalescence also can increase, with a resulting decrease in gas transfer efficiency. If the fiber membranes are less densely packed, they can spread out more, fiber to fiber contact is reduced and formed bubbles have an opportunity to move away from the fiber bundle before the bubbles coalesce with other small bubbles.

Bubble size is affected by several factors, such as gas pressure, pore size in the membrane wall and velocity and direction of the fluid relative to the fiber membrane surface.

At low gas pressures, no bubbles are formed, and gas transfer will occur by direct dissolution at the fiber membrane surface. As the gas pressure rises into the pressure range of 30–50 psi, a transition occurs and transfer is dominated by the formation of a very large number of microbubbles, that is, bubbles less than 100 microns in diameter, that stream from the micropores 50 of the hollow fiber membranes 26. At pressures in excess of 50–60 psi, the size of the bubbles increases, and bubbles as large as 2 mm may be formed.

These numbers are for clean fiber membranes of a particular type. If the fiber membranes have been exposed to wastewaters for a period of time the pressure ranges for different size bubble formation may increase.

The fiber membranes used for the tests conducted and the data provided were Mitsubishi Rayon America polyethylene membranes number EHF390C.

Different fibers manufactured by other companies will have different pore size distributions, inside diameters, wall thicknesses and surface chemistry. These differences will lead to different operating conditions for optimum bubble formation. Some membranes may not be able to form microbubbles because their surface chemistry and physical morphology are inappropriate.

For example, if a membrane has a more open structure and larger pore sizes it is to be expected that it will generate bubbles at lower gas pressures. As the average pore size of the membrane decreases the operating pressure for optimum bubble formation will increase.

The water velocity past the fiber membranes influences the shearing of the bubbles, and it also causes the fibers to fluidize, keeping them apart in the sections where bubble gas transfer takes place. Each fiber membrane 26 is preferably unaffected by interference from other fibers, to minimize bubble coalescence in the sections 28 of the fiber membranes 26.

Water velocity past the fiber membranes increase the shear forces that tend to pull bubbles from the fiber membrane surfaces, and increased velocity therefore tends to result in the formation of smaller bubbles. The boundary layer or the thickness of the stagnant liquid layer on the fiber membrane surface is very small, and the shear velocities need to be very large to exert influence at the fiber membrane surface. Membrane material types and the design of the membrane module also affect the shearing of the bubbles. The preferable fiber membranes used are made by Mitsubishi Rayon Corporation and have performed well.

A known hydrophilic material, such as polyvinyl alcohol or other suitable material, may be used to coat the external surface of the fiber membranes. This procedure can be used to modify the surface of the membrane to encourage the formation of microbubbles. The coating tends to raise the gas pressure required to form microbubbles at the outer surface. In addition, the microbubbles form over a slightly larger pressure range if the fiber membranes are coated.

Figure 2A:
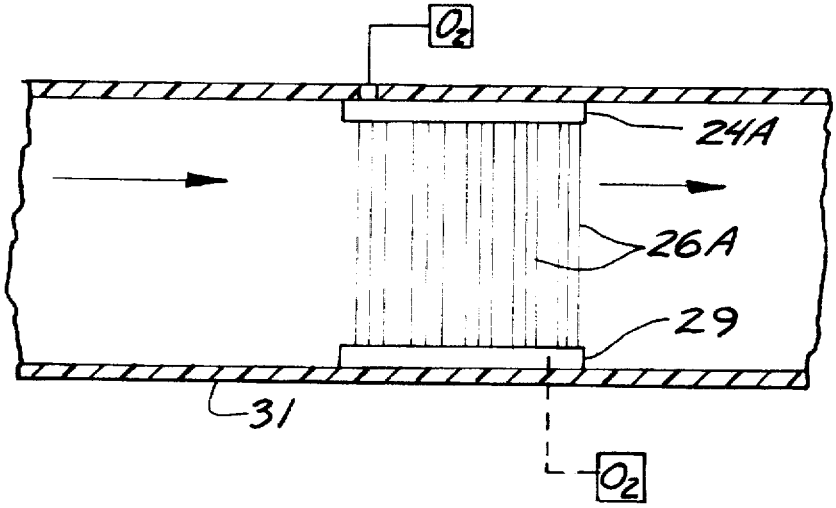
FIG. 2A is a schematic representation of a crossflow arrangement.

Membrane modules may be designed in two configurations: 1) parallel flow as shown in FIG. 1, where the fluid flow roughly parallel to the axis of the hollow fibers; or 2) crossflow as shown schematically in FIG. 2A, where the direction of fluid flow is substantially perpendicular to the axis of the hollow fibers. The preferred direction of flow for wastewater treatment applications is parallel to the fiber membranes when the wastewater contains solids. However, when waters are substantially free of solids the crossflow design is effective. The advantage of the crossflow configuration is that a thinner boundary layer is formed around the hollow fiber membranes when the fiber lengths are generally transverse to the flow, and this appears to result in a more rapid detachment of the bubbles from the fiber membrane surface. As shown in FIG. 2A, a manifold 24A similar to manifold 24 can support open ends of fibers 26A. The opposite ends of the fibers 26A can be held in potting compound in a support 29 on the opposite side of a flow housing 31. The support 29 can be a manifold such as 24A and provided with oxygen also, if desired.

In reality, designs of membrane contacting devices allow for water to flow in both parallel and crossflow modes. For example, if there is turbulent flow in the device shown in FIG. 1 there will be a crossflow component even though the bulk flow is parallel to the fiber membranes. In addition it is beneficial to develop a device having elements of both parallel and crossflow. The parallel flow component keeps the fibers clean if solids are present and yet the crossflow component provides for higher gas transfer rates and smaller bubble formation.

External liquid flows which are parallel to the fibers will tend to keep the fibers separated, and permit solids and flocs to pass between the fiber membranes, since the fiber membranes separate and the solids can move between the fibers without impediment.

Figure 3:
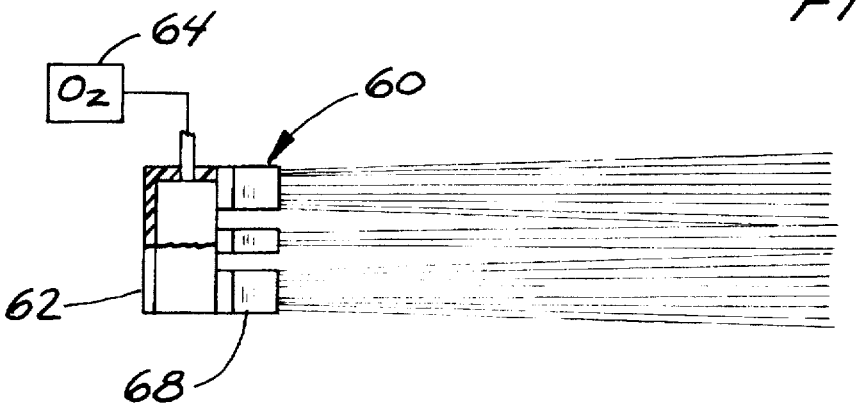
FIG. 3 is a view of a modified manifold used for holding hollow fiber membranes.
Figure 4:
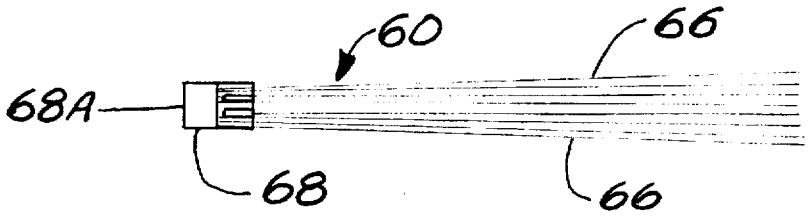
FIG. 4 is a schematic representation of a manifold insert packet holding a plurality of hollow fiber membranes.

Additional configurations of microbubble aerators that can be used are illustrated in FIGS. 3 and 4, where packets of fiber membrane indicated at 60 are formed by potting a selected number of fiber membranes into a base material to form a packet of fibers as shown in FIG. 4 and then a number of these packets are glued into a manifold 62 leading from a source of oxygen 64. The packets shown in FIG. 4 include a plurality of individual hollow fiber membranes 66 that are held in a block of potting material 68. The blocks of potting material 68 are inserted into sockets or receptacles formed in the manifold 62 and then secured in place, for example, with adhesive. The lumena of the hollow fiber membrane at the base end 68A of the potting material 68 are open, so that the oxygen can pass into the lumena. The hollow fiber membranes 66 also have sealed outer ends. The manifold construction, having individual packets of fiber membranes, provides for a wide range of configurations, because the manifold can be made with the receptacles for the packets positioned in any desired configuration. The fiber membranes are the same as those previously explained, and have micropores through the membrane walls to permit gas to pass through the walls and escape as microbubbles.

Figure 5:
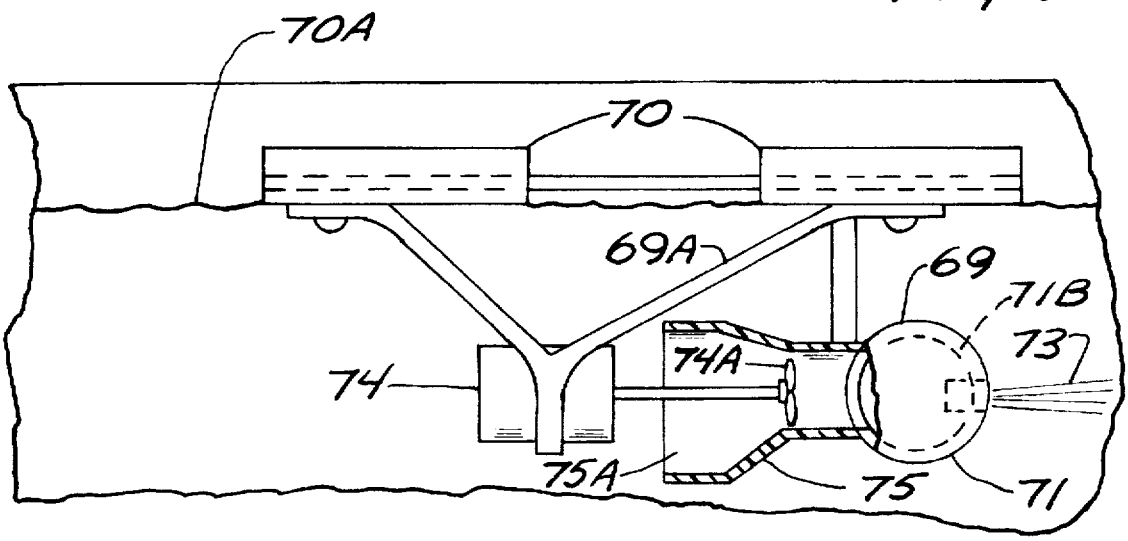
FIG. 5 is a schematic representation of a side view of a further modified installation.
Figure 6:
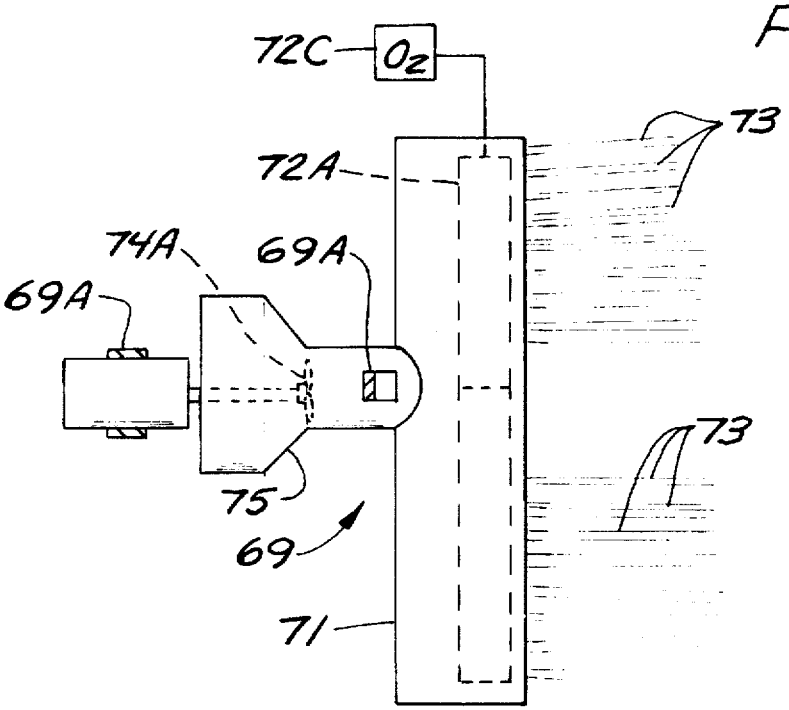
FIG. 6 is a schematic top view of the installation shown in FIG. 5.
Figure 7:
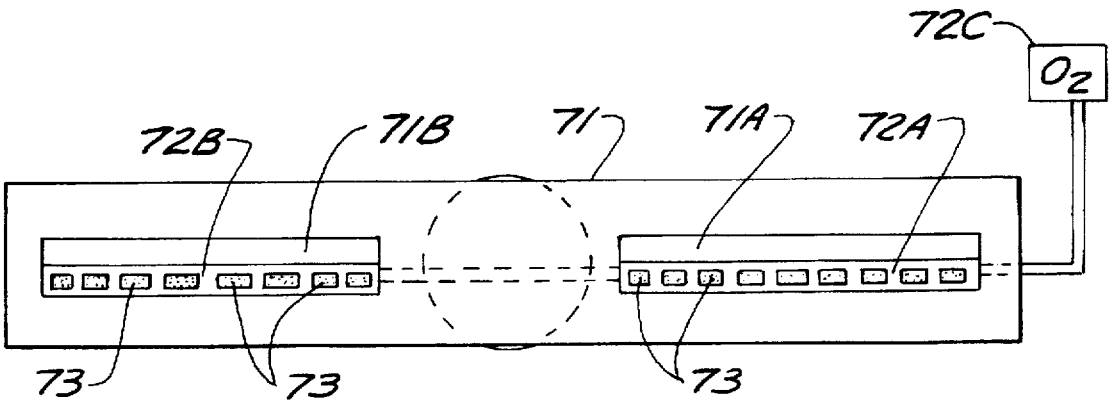
FIG. 7 is a schematic front elevational view of the installation of FIG. 6.

In FIGS. 5, 6 and 7 a schematic representation of a modified form of the invention is illustrated.

A schematic representation of an aeration tank having a water level therein illustrated in FIG. 5. In this form of the invention, an oxygenator device 69 is supported on a frame work 69A that is in turn supported on floats 70. The float on the top of the water level 70A. The aeration device 69 comprises a large tube 71 supported on the frame work 69A, and the tube has a pair of downstream facing slots illustrated at 71A and 71B (See FIG. 7). The slots 71A and 71B are large enough so manifolds 72A and 72B can be mounted within the respective slot and still leave an adequate water discharge opening. The manifolds 72A and 72B have a plurality of pockets therein for supporting a plurality of packets of fiber membranes illustrated at 73, which are made such as the packets shown in FIG. 4. The orientation of the packets in the slot can be horizontal as shown or vertical, or any orientation in between. These packets of fiber membranes 73 extend downstream from the slots 71A and 71B. As can be seen the slots remain partially open. The individual manifold 72A and 72B are connected to a suitable source of oxygen 72C for oxygenation.

In this form of the invention, the frame 69A supports a motor 74 which has a shaft driven propeller 74A that fits inside a tubular header 75, which in turn opens into the interior of tube 71. This header 75 is submerged, as shown, and when the motor 74 is powered, the propeller 74 acts as a pump, and water is drawn into the inlet end 75A of the header and forced out of the slots 71A and 71B past the fiber membranes in the packets 73. Oxygen is introduced through the manifolds 72A and 72B, and out through the hollow fiber membranes 73 as previously described.

By arranging suitable powered pumps in a water body, such as a tank, a lagoon, lake or pond, the oxygenated water discharged from the pumps can be circulated and mixed with a high degree of control.

The bubble rich discharge from the slots 73A as the water moves past the fiber membranes 73 creates a sheet flow, as shown, to provide controlled oxygenation to any depth below the water level. The depth of submersion of the oxygenator 69 can be adjusted for shallow or deep aeration merely by adjusting the frame 69A. The angle of discharge may also be used. The discharge in FIG. 5 is depicted as horizontal but it may be directed downwards too. The inclination of the discharge will be determined by the tank configuration, the depth of the water being oxygenated and the circulation patterns required to meet the treatment objections for a particular application.

This flexibility in operation allows the oxygenator to be used effectively in a variety of applications. For example, in facultative lagoons, it is desirable to aerate the surface water while maintaining an anaerobic environment at the bottom of the lagoon. Typically this is difficult to achieve with conventional aeration devices since the efficiency of gas dissolution is very poor in shallow waters and normal aerators tend to mix the top and bottom waters. However, with the present micropore membrane technology, the bubbles are very small and they are dispersed in a manner that encourages their dissolution. A large dense jet of bubble rich water is avoided and the buoyancy of the gas/water discharge is thereby reduced so that the bubbles are mixed effectively with the surrounding water rather than floating up to the surface. In addition, the discharge of the water through horizontal slots limits the scale of turbulence generated by the oxygenator and restricts the energy dissipation to the depth at which the water is discharged. Thus it is feasible to oxygenate a mixed surface water without disturbing the anaerobic bottom waters.

Figure 8:
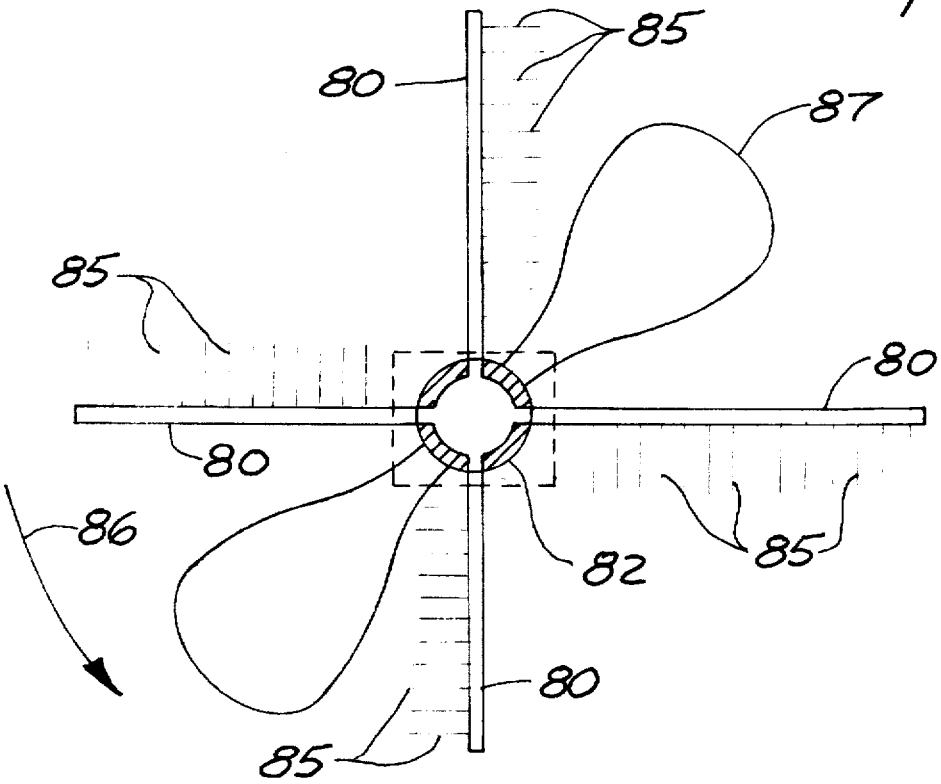
FIG. 8 is a schematic top plan view of a number of hollow fiber membranes supported on radially extending arms that rotate with a hub about a central axis.
Figure 9:
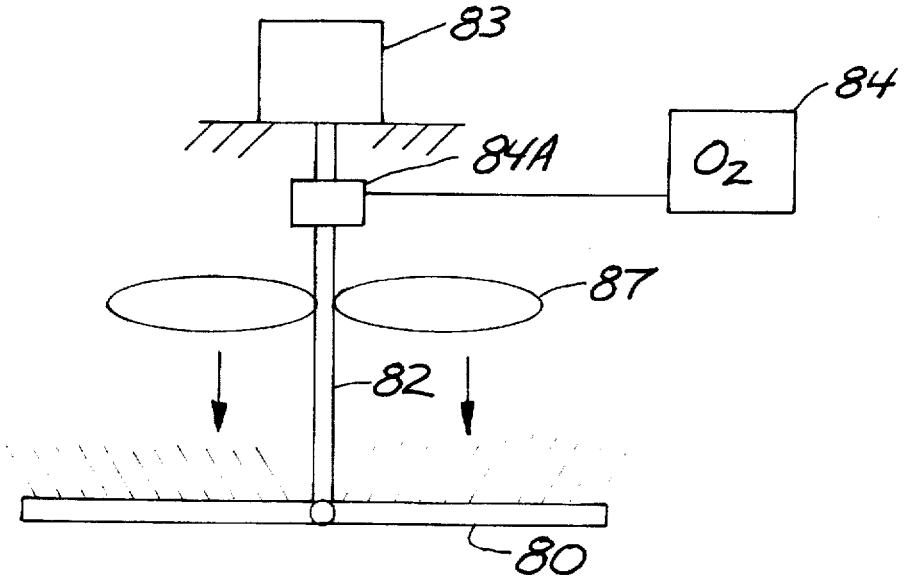
FIG. 9 is a schematic side elevational view of the device of FIG. 8.

FIGS. 8 and 9 schematically show another form of the mechanism used for delivery of gases into a liquid. A plurality of radial manifold arms 80 are provided, mounted onto a central vertical hollow hub or pipe 82 that is driven rotationally with a motor 83. A source of oxygen under pressure indicated at 84 is connected through a slip ring or rotary flow carrying joint connection 84A of known design to the central vertical pipe 82 that delivers oxygen to plenums in the manifold arms 80. The vertical pipe 82 as shown provides a common chamber that opens to each arm 80. The arms 80 form gas manifolds supporting hollow fiber membranes 85 preferably formed into membrane packets as shown in FIG. 4. The fiber membranes 85 are held spaced along the length of the manifold arms 80. If the arms 80 are rotated in direction as indicated by the arrow 86, the fibers will move through water in a tank in which the arms 80 are located, rather than flowing the water past the fiber membranes. The radial arms 80, as stated, are hollow and form manifolds that provide oxygen under pressure from source 84 to the individual fiber membranes.

The vertical pipe 82 can be fitted with a standard mixing impeller 87 of an appropriate size and configuration for the power of the motor 83. The impeller 87 will be selected to generate a water flow that moves downward so that it provides some flow that is perpendicular to the membrane fibers 85 that are rotating through the water. The large water flow generated by the impeller 87 will also effectively disperse the bubbles throughout the liquid in the tank. The impeller 87 can be engineered to provide the required mixing energy to keep microbial solids suspended in the bioreactors typically used in wastewater treatment.

Each radial manifold arm 80 can be fitted with more than one row of fiber membrane packets, depending upon the design requirements, and the velocity of the arms 80 can be adjusted by having an adjustable speed motor 83 or other suitable adjustable speed drive.

Figure 10:
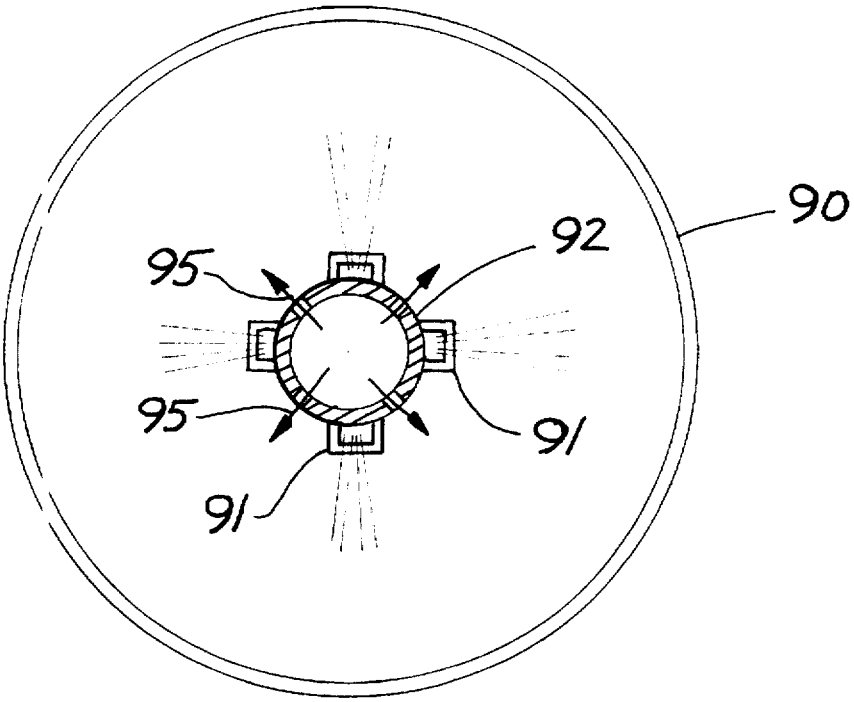
FIG. 10 is a schematic plan view of a further modified form of the present invention used in a circular mixer arrangement.
Figure 11:
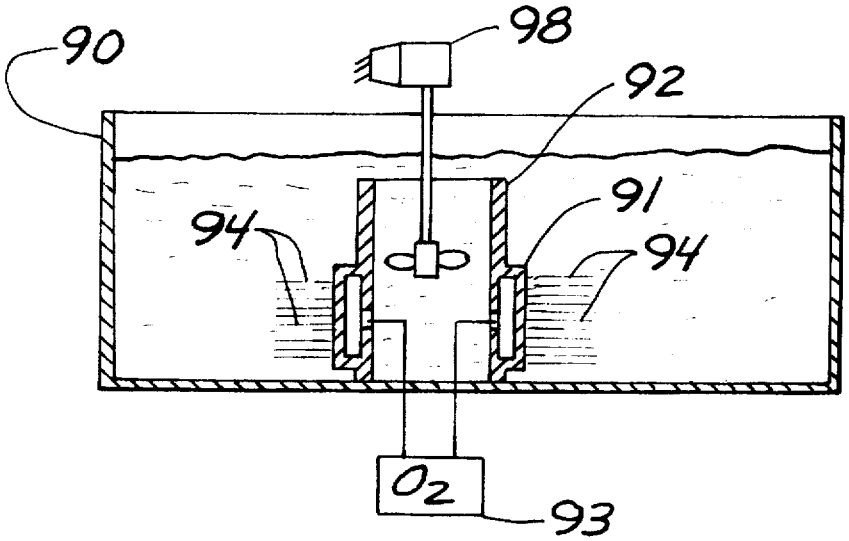
FIG. 11 is a schematic side view of the device in FIG. 10.

FIGS. 10 and 11 show an additional configuration schematically. A tank 90 contains water to be aerated, and has a center tubular shroud 92 formed therein. The shroud 92 has manifold sections 91 that are supplied with gas from a source 93. The outer wall of the shroud is formed to receive and hold membrane packets of the type shown in FIG. 4 having individual hollow fiber membranes 94 extending from the shroud 92. The shroud 92 also has slots through it that are isolated from the interior gas carrying manifold chamber to permit water to flow outwardly as indicated by the arrows 95, past the hollow fiber membranes 94. The water is discharged radially from a mixer 98 which causes a flow sufficient to fluidize the fiber membranes effectively. The water velocity and gas pressures can be selected to ensure that there is adequate aeration. The structure of FIGS. 8 and 9 causes radial flow from the shroud and axial flow along the fibers 94. The rate of flow can be controlled by regulating mixer 98 and the pressure of the oxygen also can be controlled.

Figure 12:
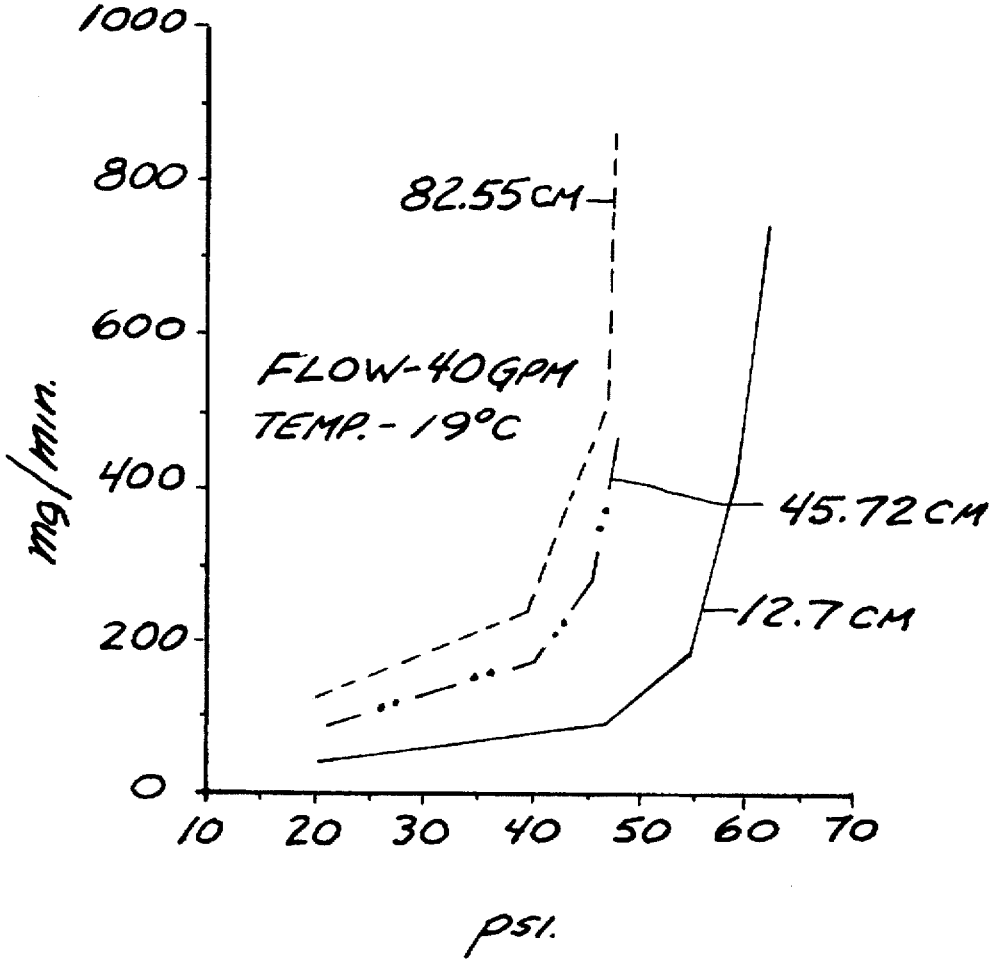
FIG. 12 is a graphical representation of the effect on the gas pressure on the transfer rate into a liquid with different effective lengths of hollow fiber membranes made according to the present invention.

FIG. 12 is a graphical representations showing the effect of increasing length of the hollow fiber membranes. The tests were conducted using the Mitsubishi Rayon America EHF 390C fiber membranes.

The individual gas transfer lengths of the fiber membranes that are shown are 12.7 cm; 45.72 cm and 82.55 cm. The hollow fiber membranes used were the same length in these tests, but the effective gas transfer length tested was decreased by treating part of the hollow fiber membrane near the sealed end to prevent gas transfer through the walls and shorten the effective length of the membranes generating microbubbles.

The mass flow rate of oxygen from the hollow fiber membranes into the water as a function of operating gas pressure is illustrated. The transfer in milligrams per minute shows that as the effective gas transfer length increases and more fiber area is provided, more gas can be transferred.

For example, at 40 psi gas pressure, the transfer was essentially 100% efficient 60 mg per minute of oxygen transferred from the 12.7 cm long hollow fiber membrane as shown in FIG. 12. If the mass flux was constant, the 45.72 cm long fiber membranes should transfer approximately four times the oxygen, or approximately 240 mg per minute. However, the 45.72 cm long effective transfer length only transferred approximately 120 mg of oxygen per minute, about half the expected performance. This effect becomes more exaggerated in longer fiber membrane lengths. For example, there appears to be no significant difference between the oxygen transfer rate for fiber membranes that had 64.8 cm long transfer section (not illustrated) and fiber membranes that had 82.55 cm. long transfer sections. Thus, maintaining the fiber lengths within a desired range of 15–30 cm would appear to increase overall cost efficiency.

Transfer efficiency of fiber membranes as a function of the mass transfer rate for fiber membranes of different fiber membrane population or density was also compared. Two membrane modules were tested with different numbers of fibers mounted inside a 2 inch ID pipe. The first module contained 176 fibers and the second contained 640 fibers. The cross sectional area of the two modules was held the same so that the water velocity past the membranes was constant. The hollow fiber membrane density thus was much greater in the second module. When the flow rate of water past the hollow fiber membranes was maintained at 40 gallons per minute, the difference in behavior between the two modules with different densities, illustrated a better efficiency for the less dense module compared to the more dense module. The drop in mass transfer rate along the fiber length is also affected by the operating gas pressure in the fiber lumen. The effect of operating pressure was demonstrated by using 30 psi for the gas supply, the mass transfer rate changed very little for lengths above 40 cm, whereas at a 45 psi gas supply, a more linear increase in transfer rate with increasing effective fiber membrane lengths was noted.

Therefore, by selecting the fiber length, and operating pressure, as well as the density of the fiber membranes themselves, control over the efficiency can be obtained, and the mass transfer rate can be enhanced.

The range of water velocity past the fibers in longitudinal direction range between 1.0 and 2.0 meters per second, while the preferred flow velocity is greater than 1.3 meters per second. Velocities from 1.0 to 2.0 meters per second are satisfactory. Also, the preferable effective gas transfer length of hollow fiber membranes of the desired size is in the range of between 12 cm and 45 cm with an operating gas pressure between 20 psi and 45 psi above water pressure for clean fiber membranes. This may increase with fiber membrane use. The pressure range of the gas can range between 10 psi and 100 psi.

Gas flowrates that can be delivered by fiber membrane inserts are currently in the range of 1–20 ml/min of gas per foot of fiber length. The efficiency of gas transfer is related to the operating gas flowrate, the configuration of the membranes is a module, packing density, depth of submergence and other parameters discussed. The efficiency of transfer tends to decrease as the operating gas flowrate is increased. For example, in one test conducted in the laboratory at 1 to 2 ml/min per foot the transfer efficiency was greater than 95%. At 5 ml/min per foot, the efficiency dropped to 75–85%, with other test parameters maintained the same.

The depth at which the bubbles are introduced affects the transfer efficiency of the membrane module. The efficiencies listed were measured with the membrane located at a depth of one foot. Higher efficiencies would result if the modules were at a greater depth, to provide a greater residence time for the bubbles in the water.

The length of the fiber membrane is important and affects the gas transfer performance of the membranes. Shorter fiber lengths appear to work most effectively since the flow is locally turbulent and velocity of the water past the membranes remains high. With longer fibers, a drop in performance is noted and there are several reasons for this, including:

(1) reduced fiber membrane fluidization and less fiber membrane movement close to the fixed end (2) decreasing gas pressure along the fiber membrane (3) decreasing water velocity along the fiber membrane length, especially if the flow is diverging.

The pores of the hollow fiber membranes are blocked adjacent to the manifolds as shown at 30 in FIG. 1, and the length of blockage can be selected to ensure that the fiber membranes are separated at the location where the gas transfer through the micropores is commenced. In other words, the fiber membranes can be mounted in manifolds with the manifold ends very closely packed together, but the fiber membranes then are blocked from passing the gas through micropores until such location as the fiber membranes are spaced to permit water to shear off microbubbles without having excessive coalescence of the bubbles. This arrangement, coupled with the closing or blocking of the remote ends of the lumens ensures that the central portions of the fiber membranes will continue to pass the bubbles through the micropores at an efficient rate.

The fiber membranes are generally manufactured from polymers such as polyethylene, polypropylene, polymethylpentene, and polysulfone. These membranes are hydrophobic such that the fiber membrane pores will remain dry and air filled when the fibers are in contact with water.

The fiber membranes allow passage of liquids so that any water entering the fiber membranes during installation or operation (e.g. when the gas source is changed) can be expelled by simple pressurization of the fiber membranes. Cleaning and liquid antifoulant chemical treatments can be administered directly to the fiber membranes by pumping the fluid (gaseous or liquid) directly into the gas supply line when the fiber membrane permit, expelling the liquid through the micropores. Surfactant solutions used for periodic cleaning of the fiber membranes can be deliberately used to modify the local surface tension and/or the membrane surface to encourage high mass transfer rates and smaller bubble diameters.

While specific membrane designs provide different parameters for operation, the effect of the velocity of water past the membrane on controlling biofilm development will be similar for any fiber membrane used in this application. The high velocity tend to shed cells from the surface of the fiber membranes and this keeps the surface clean and the pores uncovered for effective gas transfer.

The coating to prevent gas transfer at the base of the fibers near the manifold to control bubble formation in this region is important to provide more uniform dispersion of gas at more remote portions of the fiber membranes.

The length of the fiber membranes will be governed by the gas pressures that will be required within the fiber for good microbubble formation. While short fibers will always be preferred over longer fibers because the pressure drop along the fiber is less, the maximum length of fiber that may be used could vary between different manufacturers. This effect is also going to be influenced by the size, and the size distribution, of the pores in the fiber membrane walls; the inside diameter of the fiber membrane and the gas flowrate delivered to the water. For example, longer fiber membranes may be used if the inside diameter of the fiber membrane is larger (since this will reduce the effective pressure drop along the fiber length) and longer fiber membranes would also be effective if the pores were smaller, since these small pores will allow less gas flow per unit area of fiber.

Further, high velocity water moving past the fiber membranes provides a high shear action on the fiber membrane surface. This keeps the fiber membrane surface free of biological growth and is especially important when the membrane is used in wastewater treatment applications.

Although the present invention has been described with reference to preferred embodiments, workers skilled in the art will recognize that changes may be made in form and detail without departing from the spirit and scope of the invention.

What is claimed is:

1. An aeration device comprising a manifold;

a plurality of hollow fiber membranes supported in the manifold for receiving gas under pressure in lumens of the hollow fiber membranes, the lumens being closed at an opposite end from the manifold, the hollow fiber membranes having a wall having micropore passage ways therethrough in the range of 0.1 to 10 microns effective diameter; and a source of pressurized gas providing gas under pressure between 10 psi and 100 psi such that when a flow of water past the fibers is provided, bubbles ranging between 5 and 100 microns in diameter are formed and detach from exterior surfaces of the hollow fiber.

2. The aeration device of claim 1 wherein a length of hollow fiber membranes having open micropores therethrough is provided at a location spaced from the manifold such that adjacent hollow fiber membranes are spaced from each from each other as water flows past the hollow fiber membranes.

3. The aeration device of claim 1 and a water supply flowing at a velocity of between 0.5 and 2.0 meters per second past the hollow fiber membranes.

4. The aeration of claim 1 in which the hollow fiber membranes have an external diameter in the range of 100 microns to 1,000 microns.

5. The aeration device of claim 1 wherein the hollow fiber membranes extend substantially parallel to the provided flow of water.

6. The aeration device of claim 1 wherein the hollow fiber membranes have length extending transverse to the direction of flow of water past the membrane.

7. The aeration device of claim 1 wherein the manifold is supported radially with respect to a central hub, and a drive to rotate the hub and move the manifold about a central axis.

8. The aeration device of claim 7, and an impeller rotated with the hub and positioned in water to cause mixing and moving water toward the fiber membranes.

9. An aeration device comprising a manifold;

a plurality of hollow fiber membranes supported in the manifold for receiving gas under pressure in lumens of the hollow fiber membranes, the lumens being closed at an opposite end from the manifold, the hollow fiber membranes having a wall having micropore passage ways therethrough in the range of 0.1 to 10 microns effective diameter; and a source of pressurized gas providing gas under pressure between 10 psi and 100 psi such that when a flow of water past the fibers is provided, bubbles ranging between 5 and 100 microns in diameter are formed and detach from exterior surfaces of the hollow fiber membranes, wherein the fibers are mounted in a manifold at a selected density such that water flowing past the fibers tends to fluidize the fibers and cause them to be spaced apart at a location downstream from the manifold, and the hollow fiber membranes having their micropores closed along a length thereof for a selected distance downstream from the manifold substantially equal to the distance to the location where the hollow fiber membranes are well fluidized.

10. The aeration device of claim 9 in which water moving past the hollow fiber membranes separates the fibers sufficiently such that bubble formation at each individual fiber is not substantially influenced by bubble formation of adjacent fibers.

11. A method of providing for gas transfer between an elongated hollow fiber membrane having a lumen and having micropores in a wall thereof providing a gas passageway from the lumens to an exterior of the hollow fiber membrane, comprising the steps of;

closing one end of an elongated hollow fiber membrane;

supporting a second end of the hollow fiber membrane with a plurality of like hollow fiber membranes and providing a gas under pressure into the lumens of the hollow fiber membrane;

providing a flow of liquid past the hollow fiber membrane;

providing micropores through the wall of the hollow fiber membrane of size such that bubbles in the range of 5 to 100 microns are formed at the exterior surface of the hollow fiber membrane under a selected pressure of gas in the lumen; and blocking passage of gas through the micropores of the hollow fiber membrane for a selected distance from the manifold.

12. The method of claim 11 including the step of adjusting the flow of the liquid past the fibers in relation to the density of the fibers such that the blocking continues for a distance from the manifold location where the fibers are closely adjacent with each other.

13. The method of claim 11 including the step of adjusting the pressure of the gas in relation to the length of the hollow fiber membrane for efficiently transferring gas to a liquid along a selected region of the hollow fiber membrane.

* * * * *

UNITED STATES PATENT AND TRADEMARK OFFICE

CERTIFICATE OF CORRECTION

PATENT NO. : 5,674,433

DATED : October 7, 1997

INVENTOR(S) : Michael J. Semmens et al.

It is certified that error appears in the above-indentified patent and that said Letters Patent is hereby corrected as shown below:

Column 11, at the end of line 52, before the period add the following: --membranes, wherein the microporous passageways of the hollow fiber membranes are sealed to prevent passage of gas for a selected distance along the hollow fiber membranes from the manifold toward the opposite end--

Signed and Sealed this

Eighth Day of September, 1998

*Attest:*

Bruce Lehman

BRUCE LEHMAN

*Attesting Officer*

*Commissioner of Patents and Trademarks*